US007188508B2

(12) United States Patent
Bowles et al.

(10) Patent No.: US 7,188,508 B2
(45) Date of Patent: Mar. 13, 2007

(54) JAW ARM FOR COMPRESSION TOOLS

(75) Inventors: Richard R. Bowles, Solon, OH (US); James E. Hamm, Grafton, OH (US)

(73) Assignee: Emerson Electric Co., St. Louis, MO (US)

( * ) Notice: Subject to any disclaimer, the term of this patent is extended or adjusted under 35 U.S.C. 154(b) by 80 days.

(21) Appl. No.: 10/903,542

(22) Filed: Aug. 2, 2004

(65) Prior Publication Data

US 2006/0021416 A1 Feb. 2, 2006

(51) Int. Cl.
*B21D 39/04* (2006.01)

(52) U.S. Cl. ..... 72/416; 29/237

(58) Field of Classification Search ..... 72/416, 72/413, 453.16, 453.15; 29/237, 268; 81/421, 81/424, 424.5, 426.5
See application file for complete search history.

(56) References Cited

U.S. PATENT DOCUMENTS

| | | | | |
|---|---|---|---|---|
| 1,858,418 | A | 5/1932 | Rowley | |
| 2,121,669 | A * | 6/1938 | Rochte | 81/3.6 |
| 2,219,479 | A * | 10/1940 | Harry | 294/112 |
| 2,285,683 | A * | 6/1942 | Seashore | 81/424 |
| 2,352,917 | A * | 7/1944 | Scott | 81/421 |
| 2,555,591 | A * | 6/1951 | Kane, Jr. | 285/334.5 |
| 2,882,768 | A * | 4/1959 | Nelson | 81/424 |
| 3,061,357 | A * | 10/1962 | Wright | 294/106 |
| 3,662,450 | A | 5/1972 | Kish et al. | |
| 5,022,291 | A * | 6/1991 | McBain | 81/424 |
| 5,148,698 | A * | 9/1992 | Dischler | 72/409.08 |
| 5,209,100 | A | 5/1993 | Dischler | |
| 5,255,579 | A * | 10/1993 | Fortin | 81/424 |
| 5,611,236 | A | 3/1997 | Grunwald | |
| 5,991,997 | A | 11/1999 | Schley et al. | |
| 6,000,686 | A * | 12/1999 | Yates | 269/6 |
| 6,035,775 | A | 3/2000 | Nghiem | |
| 6,240,815 | B1 | 6/2001 | Huang | |
| 6,401,578 | B1 * | 6/2002 | Domenge | 81/424 |
| 6,434,998 | B2 | 8/2002 | Amherd | |
| 6,477,757 | B2 | 11/2002 | Viegener | |

FOREIGN PATENT DOCUMENTS

| | | |
|---|---|---|
| DE | 93 14 054.1 | 1/1994 |
| DE | 299 08 622 | 7/1999 |
| GB | 1428583 A | 3/1976 |

* cited by examiner

*Primary Examiner*—Daniel C. Crane
(74) *Attorney, Agent, or Firm*—Fay Sharpe LLP

(57) ABSTRACT

A jaw arm for a compression tool has a jaw recess at one end and a jaw insert is supported in the recess for pivotal displacement relative thereto about an insert axis. A compression tool comprises a pair of parallel spaced apart side plates, and a pair of the jaw arms pivotally mounted between the plates. The pivotal inserts are self-aligning with respect to a pipe and coupling to be crimped together and provide for use of the compression tool in areas with limited accessibility.

60 Claims, 10 Drawing Sheets

JAW ARM FOR COMPRESSION TOOLS

BACKGROUND OF THE INVENTION

This invention relates to the art of compression tools for joining pipes and couplings and, more particularly, to improvements in connection with the pivotal jaw arm members for a compression tool.

Compression tools for joining tubes or pipes and coupling components are well known as shown, for example, in U.S. Pat. No. 6,035,775 to Nghiem and U.S. Pat. No. 6,434,998 to Amherd. Such tools include a compression jaw set removably mounted on a drive mechanism by which the jaw arms of the set are displaced into compression about a pipe and coupling to join the latter. The jaw set is comprised of a pair of jaw arm members pivotally mounted between a pair of side plates and having inwardly open, opposed jaw recesses at one end and laterally inwardly facing cam surfaces at the opposite ends. The jaw arms are pivotal about pins located in openings through the jaw arms between the opposite ends thereof, and the jaw set is mountable on the drive mechanism by means of the side plates and at a location relative to the jaw set which is laterally between the pivot pins and between the pivot pins and cam surfaces of the jaw members. The drive mechanism includes cam rollers which are displaceable axially forwardly and rearwardly along the cam surfaces of the jaw members and, when displaced forwardly of the cam surfaces, the rollers engage the latter and displace the opposed jaw recesses toward one another and constrictably about a pipe and coupling disposed therebetween.

The jaw recesses are of course contoured to compressibly engage a pipe and coupling therebetween so as to sealingly interengage the components without the use of solder. Accordingly, it is critical that the jaw recesses be aligned perpendicular to the axes of the pipe and coupling during the compression operation. Failure to properly align the jaw recesses with the pipe and coupling can result in crushed fitting, or improper crimping of the pipe and coupling which can lead to leakage when the line being installed is placed in use, such as for delivering liquid under pressure. Alignment is somewhat difficult to achieve under any circumstances in that the operator of the compression tool must support the latter with the jaws open, engage the jaws about a pipe and coupling, and then actuate the drive mechanism to complete the compression process. Therefore, as will be appreciated from the aforementioned patent to Nghiem, the size and weight of the drive mechanism and jaw assembly add to the difficulty in obtaining and maintaining proper alignment between the jaw recesses, pipe and coupling, and the alignment process is made more difficult if the component parts to be compressed are located above the operator's head and/or in areas that are difficult to gain access to.

One effort to overcome the foregoing problem is shown in German Utility Model Application G 93 14 054.1 wherein jaw recesses which are integral with the jaw arm members are at an angle of about five degrees relative thereto. While such a disposition of the recesses does enable an operator to make a crimp close to an object, such as a wall, it remains that the jaw recesses are rigid relative to one another and thus to the pipe and coupling to be crimped, whereby care must be taken by the operator to assure proper alignment between the jaws and the components to be compressed.

Another approach to resolving the alignment problem is shown in U.S. Pat. No. 6,477,757 to Viegener wherein the jaw arms of a jaw set are adapted to receive an auxiliary crimping jaw attachment which is pivotal relative to the jaw arms to achieve alignment between the working faces of the attachment and the pipe and coupling to be crimped when the jaw set is attached to the drive. The attachment comprises a pair of jaw arms pivotally connected to provide a crimping ring assembly in which the jaw arms include jaw recesses which are rigid relative to one another. While this design does provide articulation between the crimping jaws of the attachment and the jaw arms of the jaw set, the design requires two separate assemblies, namely a crimping ring assembly and an actuator jaw assembly. Moreover, use of the device requires mounting of the attachment about a pipe and coupling to be crimped and, then, connection of the attachment with the jaw arms of the jaw set. It will be appreciated, therefore, that the design is expensive to construct and that use thereof is cumbersome and time-consuming and, in many cases, may require two operators to achieve the mounting of the attachment and the connection thereof to the jaw arms of the jaw set.

SUMMARY OF THE INVENTION

In accordance with the present invention, a jaw arm for a compression tool is provided with a jaw insert which is pivotal relative to the jaw arm to facilitate alignment of the insert with a corresponding portion of a tube and coupling to be crimped through the use of a compression tool. More particularly, the jaw insert is removably mounted in a recess provided therefor in a jaw arm and is supported in the recess for pivotal displacement relative to the jaw arm about an insert axis extending transverse to the pivot axis of the jaw arm. Preferably, the insert and jaw arm recess have facially interengaging arcuate surfaces so as to optimize support of the insert during a compression operation. The insert can be manually displaced relative to the jaw arm so as to establish an approximate angular position of the insert relative to the jaw arm prior to initiating a compression operation and, preferably, a biasing arrangement is provided between the jaw arm and insert which creates a torque requirement for pivoting the insert and, thus, promotes maintaining the insert in the adjusted position. Such prepositioning is of particular advantage when the location of the joint to be crimped cannot be accessed with the drive mechanism perpendicular to the axes of the pipe and coupling components to be crimped. In any event, even if the location for the compression operation is such that the drive mechanism and thus the jaw arms can be positioned perpendicular to the axes of the pipe and coupling to be joined, the pivotal capability of the insert advantageously provides for the pair of inserts on the arms of a jaw set to be self-aligning relative to the coupling components and to each other as the inserts are moved into place on opposite sides of the coupling components. Therefore, even if the operator does not have the drive mechanism exactly perpendicular to the axes of the coupling components, proper alignment of the inserts is achieved and, accordingly, proper crimping of the coupling components is achieved.

In accordance with another aspect of the invention, the opposed jaw inserts on the jaw arm members of a jaw set are provided with an arrangement for interengagement with one another during initial positioning and movement of the inserts into the crimping positions thereof to promote alignment of the inserts with one another throughout the compression operation. Such alignment further promotes obtaining a proper crimp of the pipe and coupling components.

In accordance with still another aspect of the invention, the jaw arm and the corresponding jaw insert are provided with an arrangement for interengagement therebetween which limits pivotal displacement of the insert relative to the jaw arm. Such interengagement advantageously provides for maintaining the insert in a position relative to the jaw arm which provides for the insert to be adequately supported by the jaw arm during a compression operation.

A further advantage achieved in accordance with the present invention is the ability to selectively use a number of different inserts which are accommodated in the jaw recess and which provide compression surface contours for different sizes and/or shapes of pipes and couplings.

It is accordingly an outstanding object of the present invention to provide a jaw arm member for a compression tool with a jaw insert pivotal relative thereto to accommodate alignment of the insert with a pipe and coupling during crimping thereof.

Another object is the provision of a jaw arm of the foregoing character which provides for the jaw insert to be self-aligning with respect to a pipe and coupling during a compression operation.

A further object is the provision of a jaw arm of the foregoing character in which the jaw insert is biased to remain in a preset position relative to the jaw arm as the jaw arm and insert are moved into position relative to a pipe and coupling to be joined together.

Yet another object is the provision of a jaw arm of the foregoing character in which the insert is removably mounted for the jaw arm to accommodate any one of a number of inserts having different compression profiles.

Yet a further object is the provision of a compression tool in the form of a jaw arm set in which the jaw inserts in opposed jaw arm recesses interengage so as to be aligned with one another during a crimping operation.

Still another object is the provision of a compression tool in which the jaw inserts in the opposed jaw recesses are limited with respect to the pivotal displacement thereof relative to the jaw arms so as to provide a desired support for the inserts during a compression operation.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
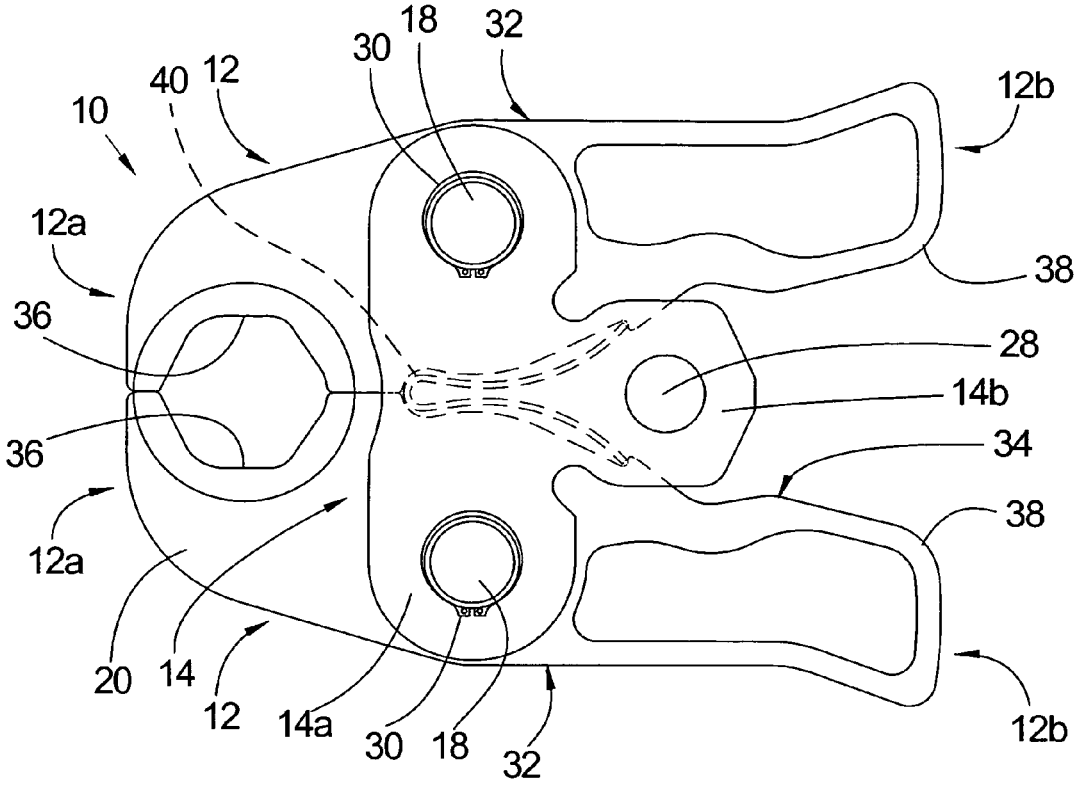
FIG. 1 is a plan view of a prior art jaw set including pivotal jaw arms of the character to which the present invention is directed.
Figure 2:
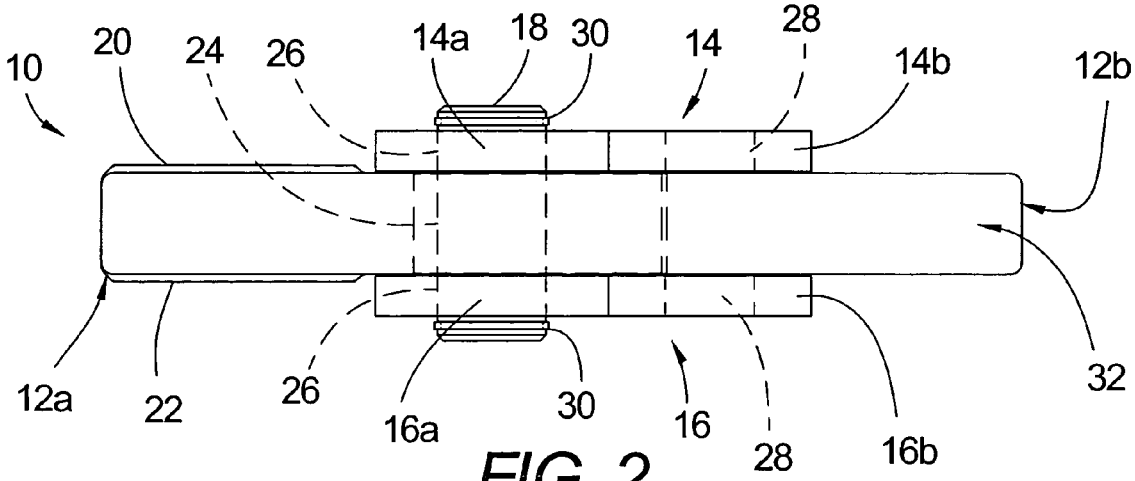
FIG. 2 is a side elevation view of the jaw set in FIG. 1.
Figure 3:
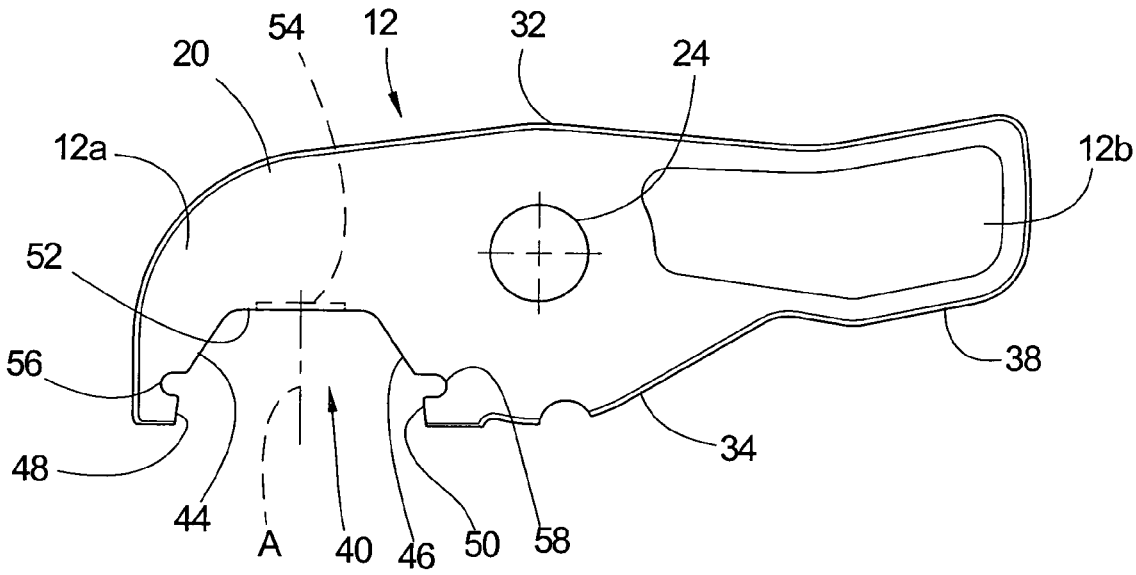
FIG. 3 is a plan view of a jaw arm having a jaw recess for receiving a jaw insert in accordance with the invention.
Figure 4:
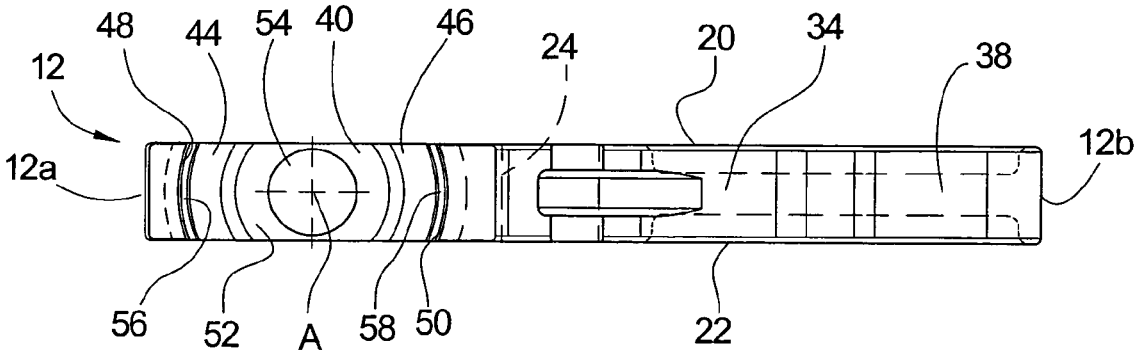
FIG. 4 is a side view of the inner side of the jaw arm in FIG. 3.

Referring now in greater detail to the drawings, wherein the showings are for the purpose of illustrating preferred embodiments of the invention only and not for the purpose of limiting the invention, FIGS. 1 and 2 illustrate a prior art jaw set 10 comprising a pair of jaw arm members 12 which are mounted, in the orientation shown in FIGS. 1 and 2, between top and bottom side plates 14 and 16, respectively, by a corresponding pivot or bearing pin 18. Each of the jaw arm members has a top side 20, a bottom side 22, and a pin opening 24 therethrough for receiving the corresponding pin 18. Side plates 14 and 16 are generally T-shaped and include laterally opposite sides 14*a* and 16*a*, respectively, which are provided with aligned holes 26 for receiving the outer ends of the corresponding pin 18. Side plates 14 and 16 further include rear ends 14*b* and 16*b*, respectively, which are provided with aligned openings 28 therethrough which are adapted to receive a mounting pin by which the jaw set is mounted on a drive unit in a well-known manner. The jaw arm members and side plates are retained in assembled relationship by spring clips 30 on the opposite ends of each of the pins 18.

Each of the jaw arm members 12 has longitudinally opposite front and rear ends 12*a* and 12*b*, respectively, and laterally outer and inner edges 32 and 34, respectively, which are spaced from opening 24 and extend forwardly and rearwardly of the opening. Inner edges 34 of the jaw arm members are provided with laterally inwardly open opposed jaw recesses 36 at front ends 12*a* and forwardly of the side plate, and laterally inwardly facing cam surfaces 38 at rear ends 12*b* and rearwardly of rear ends 14*b* and 16*b* of the side plates. Inner sides 34, laterally inwardly of pin openings 24, receive and support a hairpin-shaped spring 40 which biases jaw arm members 12 in opposite directions about pins 18 to bias jaw recesses 36 laterally inwardly toward one another. Each of the jaw recesses is integral with the corresponding jaw arm member, and the recesses are contoured to provide working surfaces which cooperatively engage about component parts to be joined by compression.

In use, jaw set 10 is mounted on a drive mechanism in a well-known manner by means of a pin which is attached to the drive mechanism and received in side plate openings 28. Ends 12*b* of the jaw arm members are then manually displaced toward one another to pivot the arm members about pins 18 against the bias of spring 40 to open the jaw recesses 36 to receive a pipe and coupling to be compressed and, upon release of the jaw arm members, spring 40 closes the jaw recesses about the pipe and coupling. The drive unit is then actuated for the cam rollers thereon to advance axially forwardly of the jaw set and simultaneously engage against cam surfaces 38 to displace jaw arm members 12 about pins 18 for jaw recesses 36 to compress the pipe and coupling together. Thereafter, the drive unit is actuated to withdraw the cam rollers, and the jaw arm members are again manually displaced against the bias of spring 40 to open the jaw recesses for removal of the jaw set from the compressed pipe and coupling.

In accordance with the present invention, the jaw arms of a jaw set which can be similar to the jaw arms and jaw set described above in connection with FIGS. 1 and 2 are modified to provide for the jaw arms to have jaw recesses which receive and support a jaw insert for pivotal displacement relative to the corresponding jaw arm. Accordingly, in the following description of preferred embodiments of the invention, the component parts of the jaw arms and jaw set which can correspond to those shown in FIGS. 1 and 2 are designated by like numerals.

Referring first to FIGS. 3–10 of the drawing, the inner edge 34 of a jaw arm at front end 12*a* thereof is provided with an outwardly open jaw recess 40 which is contoured to receive and pivotally support a jaw insert 42 which has a working surface W which corresponds functionally with the integral jaw recess 36 of a prior art jaw arm in connection with the crimping of pipe and coupling components. In the embodiment of FIGS. 3–10, jaw recess 40 is provided with arcuate jaw insert supporting surfaces by which a jaw insert is supported for pivotal displacement relative to the jaw arm about a jaw axis A. The arcuate recess surfaces in this embodiment include inner conical surfaces 44 and 46 and corresponding outer conical surfaces 48 and 50, all of which extend between sides 20 and 22 of the jaw arm. Recess 40 further includes a planar inner wall 52 and, for the purpose set forth hereinafter, the inner wall is provided with an outwardly extending circular recess 54 which is coaxial with axis A. Further for the purpose set forth hereinafter, forwardly and rearwardly extending slots 56 and 58 are provided, respectively, between conical surfaces 44 and 48 and between conical surfaces 46 and 50. Slots 56 and 58 extend arcuately between sides 20 and 22 of the jaw arm and, preferably, are co-planar and in a plane transverse to axis A.

Figure 5:
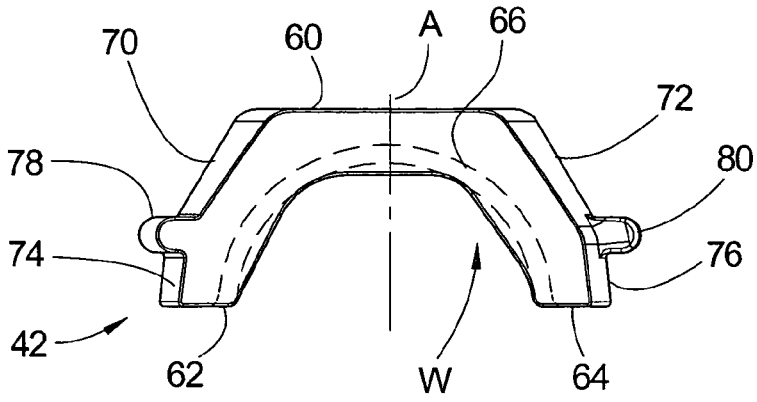
FIG. 5 is a plan view of a jaw insert for the jaw arm in FIGS. 3 and 4.
Figure 6:
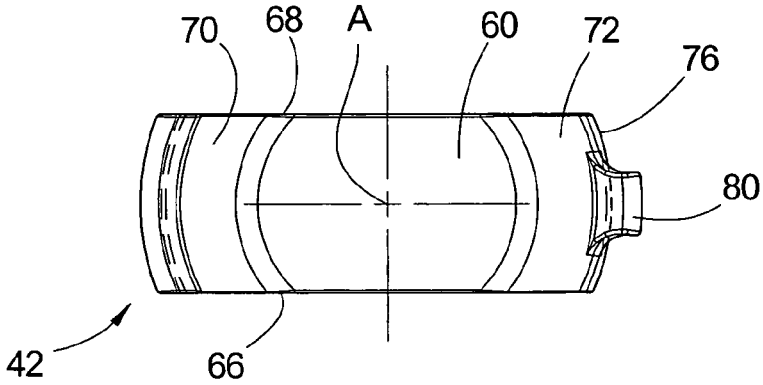
FIG. 6 is a side elevation view of the insert looking in the direction from the top toward the bottom in FIG. 5.
Figure 7:
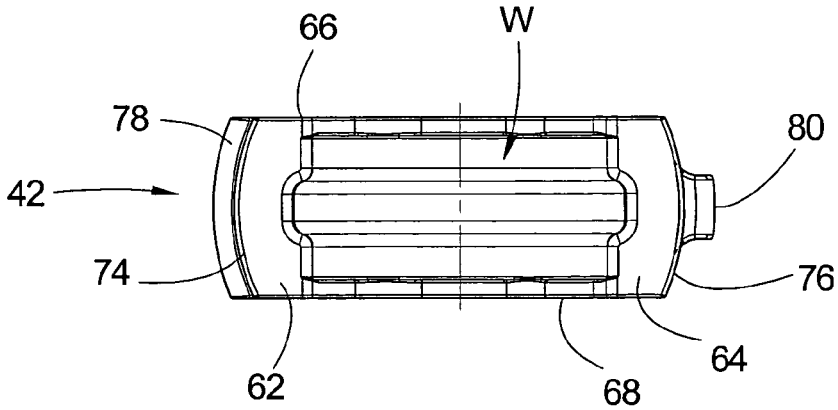
FIG. 7 is a side elevation view of the insert looking in the direction from the bottom toward the top in FIG. 5.

Referring now to FIGS. 5–7 of the drawing, insert 42 has a planar inner wall 60 and planar outer ends 62 and 64, and the distance between wall 60 and ends 62 and 64 is slightly greater than the depth of recess 40 from edge 34 of the jaw arm to inner wall 52 of the recess to assure that the opposed ends 62 and 64 of the inserts in a jaw set engage one another during a compressing operation. Insert 42 further includes opposite sides 66 and 68 which provide the insert with a width similar to the width of the jaw arm between sides 20 and 22 thereof. The insert is provided with arcuate support surfaces including inner conical surfaces 70 and 72 and corresponding outer conical surfaces 74 and 76. Conical surfaces 70 and 74 are matingly contoured for sliding interengagement with conical surfaces 44 and 48 of jaw arm recess 40, and conical surfaces 72 and 76 are matingly contoured for sliding engagement with conical surfaces 46 and 50 of the jaw arm recess. Forwardly and rearwardly extending projections 78 and 80 are provided, respectively, between conical surfaces 70 and 74 and between conical surfaces 72 and 76 and, as will become apparent hereinafter, are positioned on the insert to be slidably received in slots 56 and 58 of the jaw arm, respectively. For the purpose set forth hereinafter, projection 78 extends arcuately between sides 66 and 68 of the insert, and projection 80 is narrower than the insert and generally centrally between sides 66 and 68 thereof.

Figure 8:
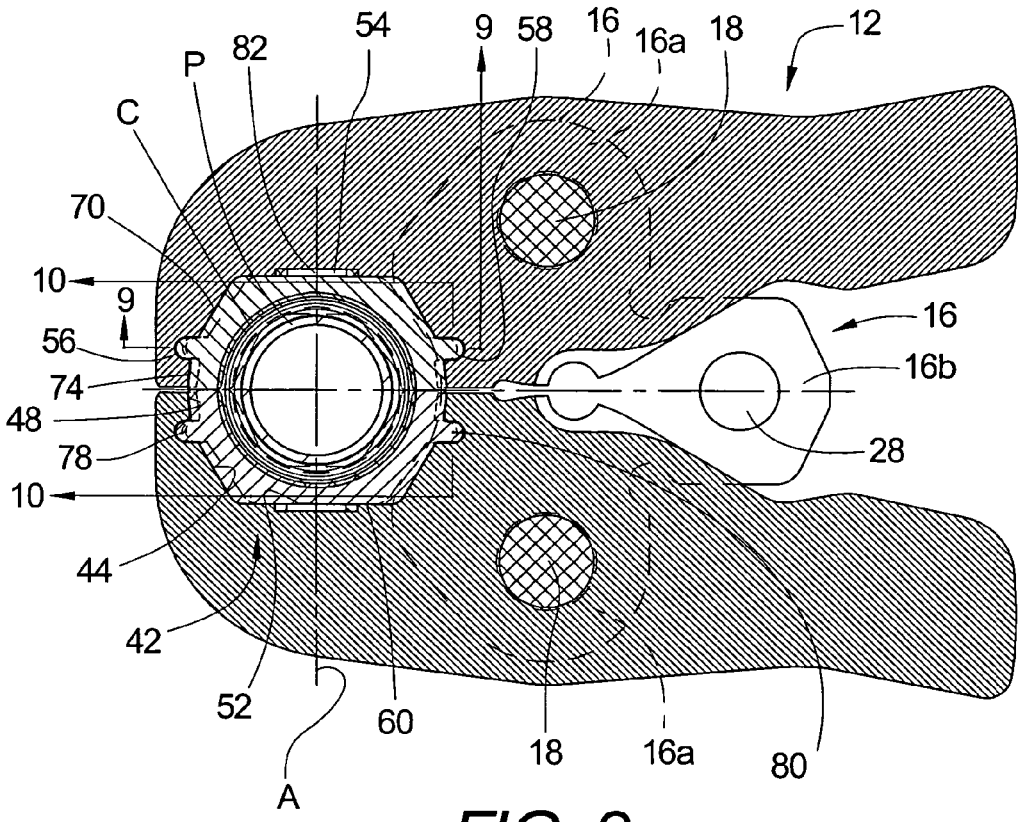
FIG. 8 is a plan view of the jaw set provided by the jaw arm and insert components shown in FIGS. 3–7.
Figure 9:
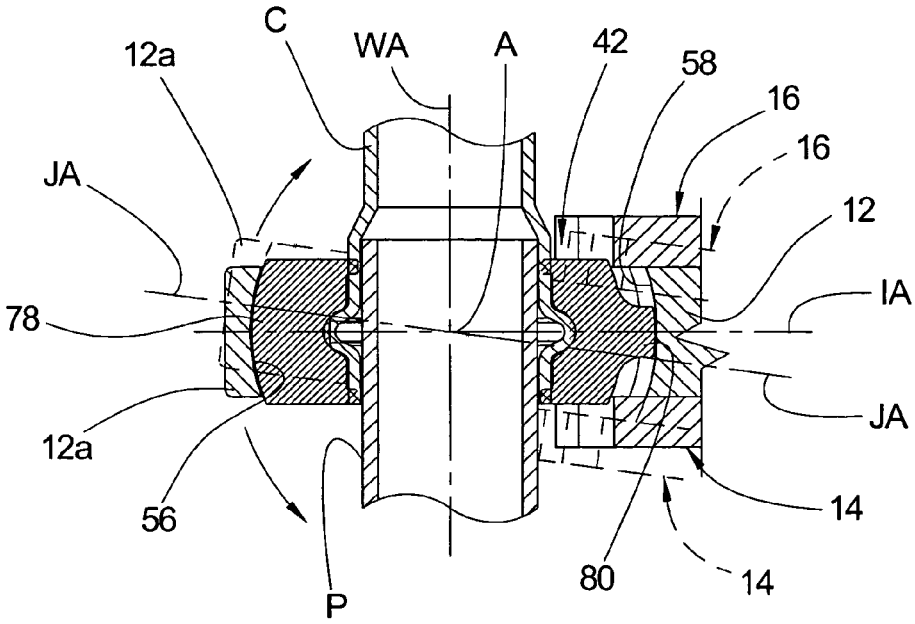
FIG. 9 is a cross-sectional view taken along line 9—9 in FIG. 8.

As will be appreciated from the foregoing description of the jaw arm and insert components, and as shown in FIGS. 8 and 9, a jaw arm and insert are assembled by pivotally sliding the insert into jaw recess 40 with projections 78 and 80 respectively received in slots 56 and 58 of the jaw arm. The slots and projections retain the insert in the jaw recess axially with respect to axis A and, preferably, a spring washer 82 is received in recess 54 in the inner wall of the jaw recess and engages between the spring recess and inner wall 60 of the insert to bias the insert axially outwardly of the jaw recess. Accordingly, the projections and slots interengage to establish a desired torque requirement for pivoting the insert relative to the jaw arm for the purpose set forth hereinafter. A jaw set is assembled by positioning a pair of jaw arms and jaw inserts between side plates 14 and 16 and interconnecting the side plates and jaw arms by inserting pins 18 as described hereinabove through the jaw arm and side plate openings. In this embodiment, as will be appreciated from FIG. 9, pivotal displacement of the jaw inserts in opposite directions about axis A is limited by the engagement of insert projections 80 with side plates 14 and 16 of the jaw set. As an alternative to this arrangement when, for example, the side plates of a jaw set do not extend forwardly to the extent shown in FIG. 9, projections 78 can be narrower than the inserts and stop plates can be mounted on the jaw arms at the opposite ends of slots 56 so as to be engaged by the projections to limit pivotal displacement of the jaw inserts about axis A.

Figure 10:
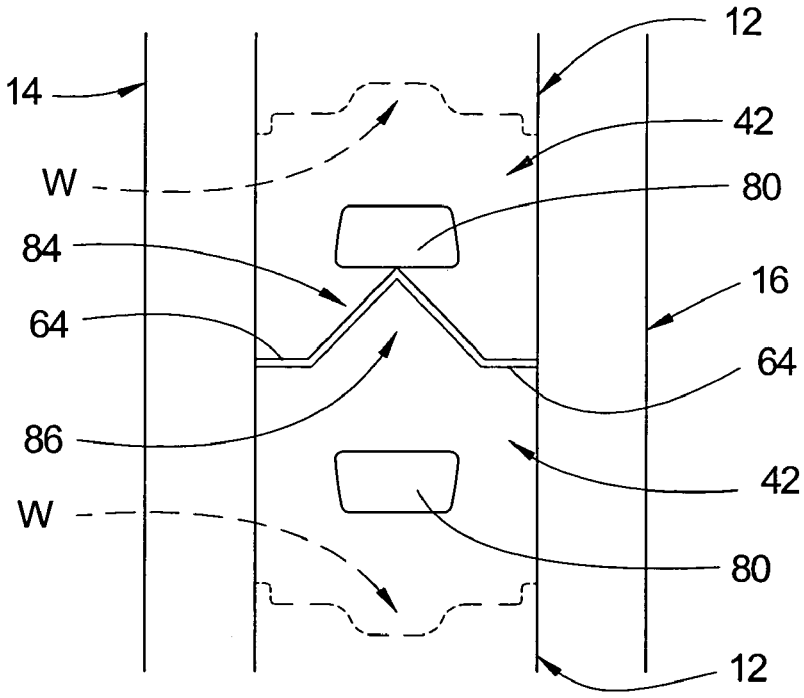
FIG. 10 is a cross-sectional view taken along line 10—10 in FIG. 8.

Preferably, as will be appreciated from FIG. 10, the outer ends 64 of the inserts are provided with interengaging components which, in this embodiment, are defined by a V-shaped recess 84 in one of the inserts and a V-shaped projection 86 in the other insert. During prepositioning, and when the inserts of a jaw set are engaged about a pipe P and coupling C to be crimped together, as shown in FIGS. 8 and 9, recess 84 and projection 86 interengage to keep the two inserts in alignment with one another. The pivotal capability of the jaw inserts relative to the jaw arms provides for the inserts to be self-aligning such that the insert axis IA is perpendicular to the work axis WA, even if the jaw arm axis JA is at an angle to work axis WA as shown by the broken line positions of the jaw arm and side plate components in FIG. 9. The pivotal capability of the jaw inserts not only provides for the inserts to be self-aligning but also enables a user to preset an angle between insert axis IA and jaw arm axis JA when the pipe and coupling components are in an area which is difficult to access. In connection with such presetting of the inserts relative to the jaw arms, the torque required to preset the position of the jaw arms, as determined by spring washer 82, advantageously holds the jaw inserts in the preset position as the components are engaged about the workpieces.

Figure 11:
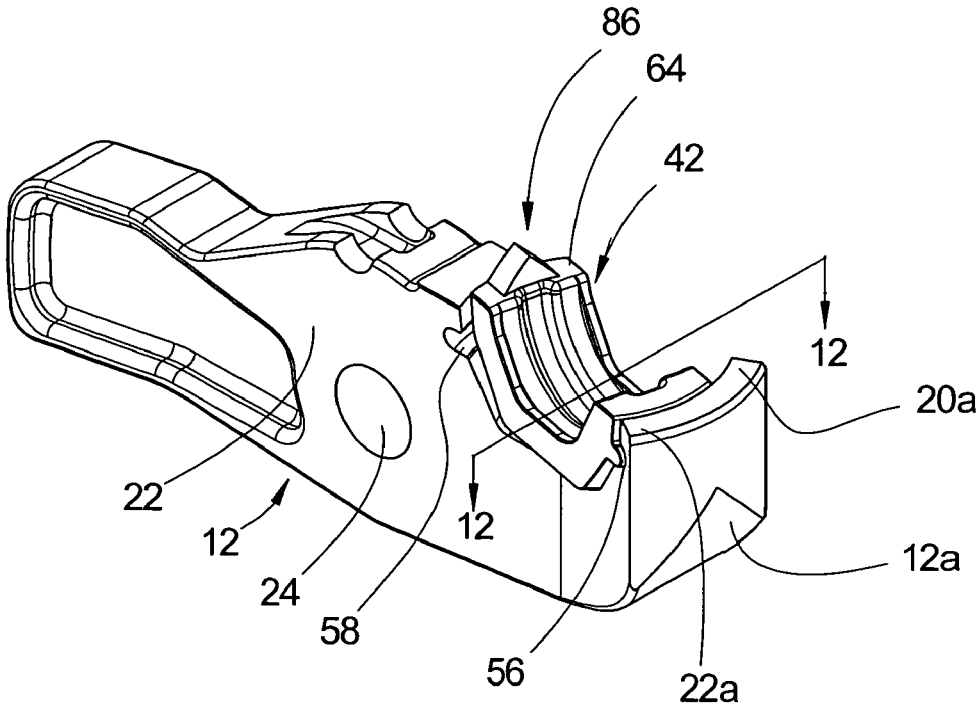
FIG. 11 is a perspective view of a modification of the jaw arm and recess in the embodiment of FIGS. 3–10.
Figure 12:
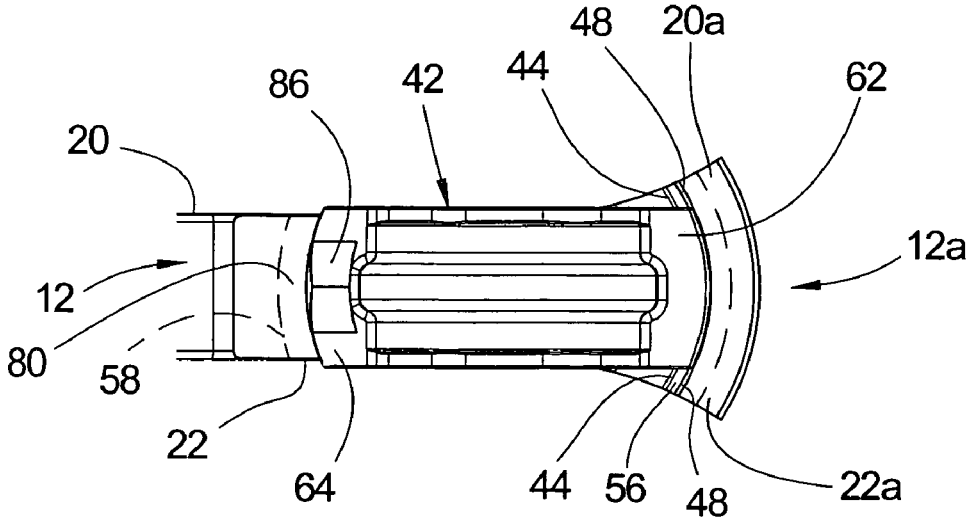
FIG. 12 is a plan view of the jaw arm and insert looking in the direction of line 12—12 in FIG. 11.

FIGS. 11 and 12 illustrate a modification of jaw arm 12 which provides additional surface area for supporting the jaw insert at the front end of the jaw arm during a compression operation with the insert at an angle to the jaw arm. More particularly in this respect, opposite sides 20 and 22 of the jaw arm at front end 12*a* thereof have laterally outwardly flared side portions 20*a* and 22*a*, respectively, which provide additional support surfaces for extending conical wall portions 44 and 48 laterally outwardly relative to the planes of sides 20 and 22 of the jaw arm. Therefore, as will be appreciated from FIG. 12, the laterally extended portions of conical surfaces 44 and 48 provide additional support for conical surfaces 70 and 74 of the insert when the latter is pivoted such as shown in FIG. 11 for the insert axis to be at an angle to the jaw arm axis. It will be appreciated, of course, that widening of the jaw arm can be achieved other than by flaring.

Figure 13:
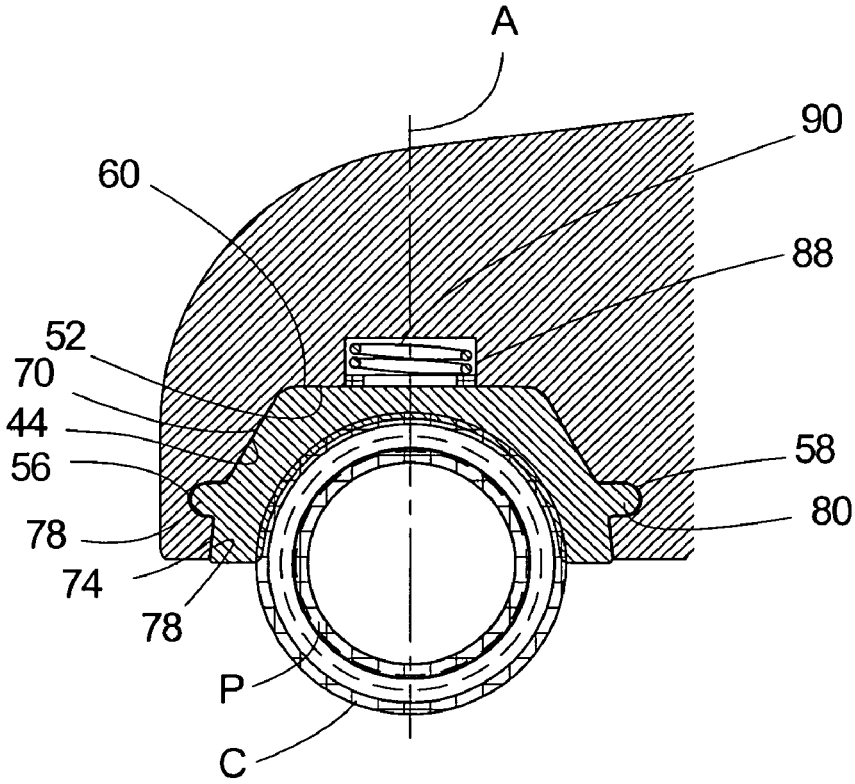
FIG. 13 is a cross-sectional view through the jaw arm and insert of FIGS. 3–10 and showing a modification of the arrangement for creating a torque requirement for pivoting the insert relative to the jaw arm.

FIG. 13 illustrates a modification of the arrangement for creating a required torque for pivoting the jaw insert relative to the corresponding jaw arm. In this respect, washer 82 in the previous embodiment is replaced by providing a bore 88 extended into the jaw arm from inner wall 52 of the jaw recess, co-axial with axis A, and interposing a coil spring 90 between the inner end wall of the bore and inner end surface 60 of the insert.

Figure 14:
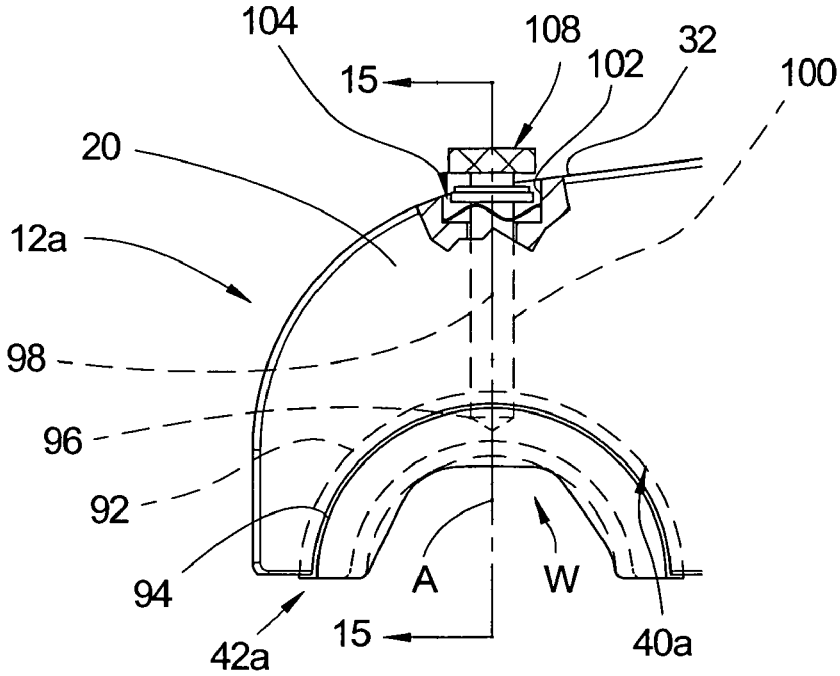
FIG. 14 is a plan view illustrating a modification of the arrangement for mounting an insert in a jaw arm recess.
Figure 15:
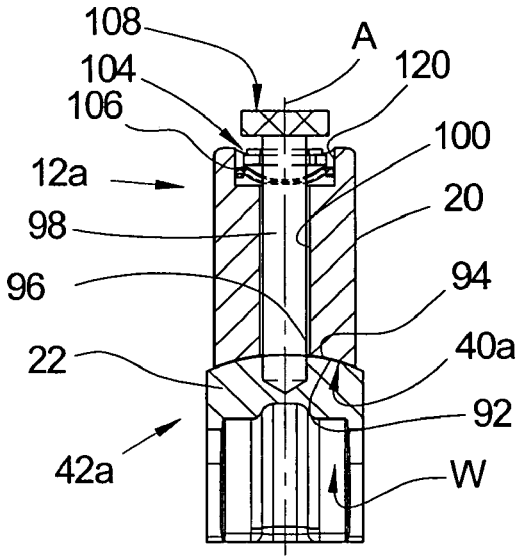
FIG. 15 is a cross-sectional view taken along line 15—15 in FIG. 14.

FIGS. 14 and 15 illustrate a modification of the arcuate support surfaces of the jaw arm recess and jaw insert and a modification of the arrangement for removably mounting the insert in the jaw recess. With regard to the support surfaces, the jaw arm designated 12A is provided with a recess 40A having a spherical support surface 92 and the insert, designated 42A, is provided with a spherical support surface 94 which is matingly contoured with surface 92 for the insert to be rotatable relative to the jaw arm about axis A. With regard to the mounting of the insert, the latter is provided with a bore 96 co-axial with axis A and which bore receives a circular pin or post 98 which is secured therein such as by an interference fit. Jaw arm 12A is provided with a bore 100 co-axial with axis A and outer edge 32 of the jaw arm includes a larger diameter recess 102 into which bore 100 opens. Bore 100 pivotally receives pin 98 which extends upwardly through the bore into recess 102 and is retained in place by a washer and snap ring arrangement 104. Preferably, a wave washer 106 is interposed between recess 102 and the washer and retaining ring arrangement to bias the insert inwardly of jaw arm recess 40A to establish a desired torque requirement for pivoting the insert relative to the jaw arm. Preferably, post 98 extends outwardly of recess 102 and is provided with an operating knob 108 by which the insert can be manually rotated relative to the jaw arm. However, the insert can be manually rotated directly as opposed to being rotated by the knob, whereby it will be appreciated that the knob is not necessary, and this is indicated by the broken line representation of the knob in FIG. 15.

Figure 16:
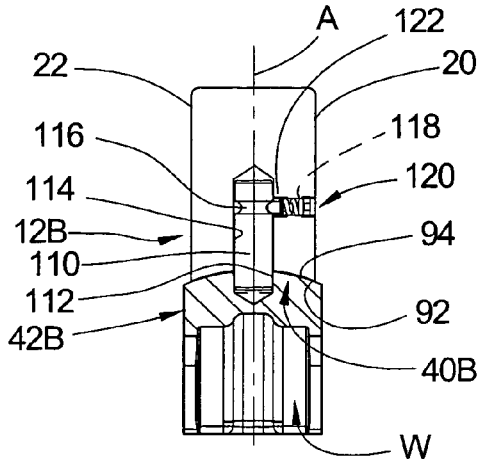
FIG. 16 is a cross-sectional view showing that another arrangement for mounting an insert in a jaw arm recess.

FIG. 16 illustrates another arrangement for removably mounting an insert in a jaw arm. In this embodiment, the jaw arm which is designated 12B has a recess 40B, and the recess and the insert which is designated 42B have spherical surfaces 92 and 94, respectively, interengaging for the insert to be pivotal relative to the jaw arm about axis A. Mounting in this embodiment is achieved by providing the insert with a pin or post 110 secured in a bore 112 in the insert, such as by an interference fit, and providing the jaw arm with a bore 114 which pivotally receives post 110. Post 110 is provided with a circumferentially continuous recess 116, and the jaw arm is provided with a bore 118 extending laterally inwardly from side 20 thereof and which bore receives a spring biased ball detent unit 120 having a ball 122 on the inner end thereof engaging in post recess 116. The force of the spring in the ball detent unit is adjustable in a well-known manner, and it will be appreciated that the insert is selectively removable from the jaw recess by a force along axis A sufficient to overcome the holding force of the ball detent unit.

Figure 17:
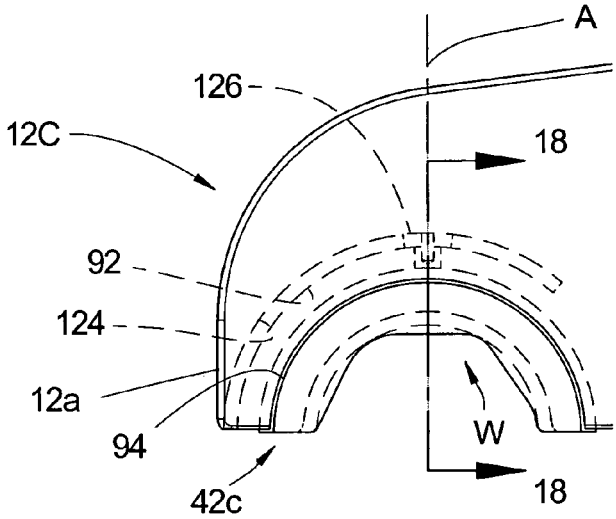
FIG. 17 is a plan view showing still another arrangement for mounting an insert in a jaw arm recess.
Figure 18:
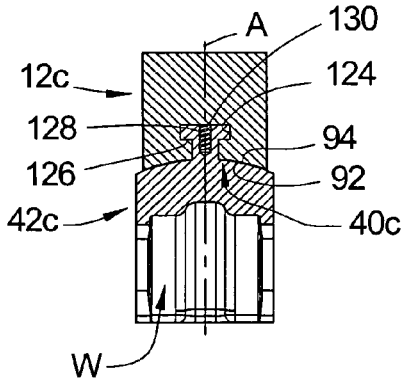
FIG. 18 is a cross-sectional view taken along line 18—18 in FIG. 17.

FIGS. 17 and 18 illustrate a further arrangement for removably mounting an insert in a jaw arm. In this embodiment, the jaw arm designated 12C has a recess 40C, and the recess and insert which is designated 42C have spherical interengaging support surfaces 92 and 94, respectively, as in the embodiments of FIGS. 14–16. The insert is removably mounted in the jaw arm recess in this embodiment by providing the jaw arm and insert with a slidably interengaging T-shaped slot and projection arrangement. More particularly, jaw arm 12C is provided with an arcuately extending T-shaped slot 124 radially outwardly of support surface 92 and which has an entrance end at the outer face of the jaw arm at end 12*a* thereof, and insert 42C has a T-shaped projection 126 which is slidably and rotatably received in slot 124. Preferably, projection 126 is provided with a bore 128 extending thereinto from the innermost end thereof, and a spring 130 is received in the bore and thus is interposed between the projection and slot to provide a desired torque requirement for pivoting the insert relative to the jaw arm.

Figure 19:
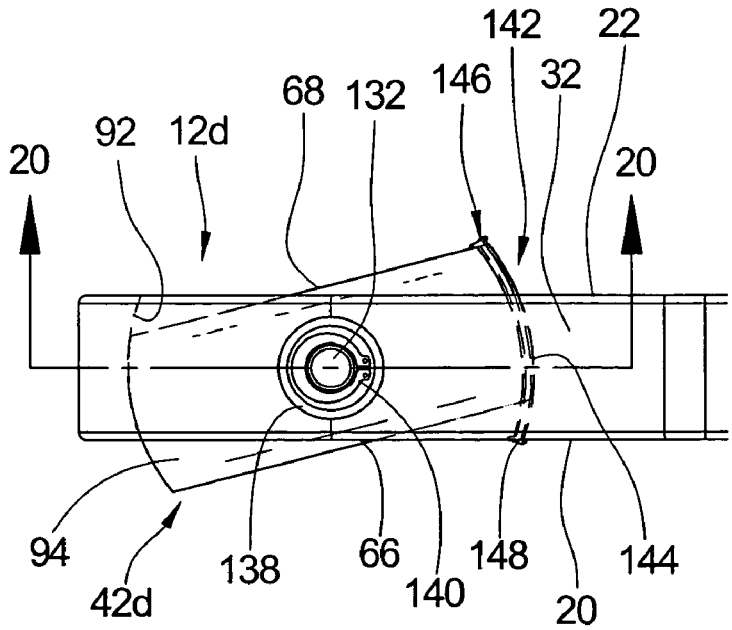
FIG. 19 is a side elevation view showing still a further arrangement for mounting an insert in a jaw arm recess and showing another arrangement for limiting pivotal displacement of the insert relative to the jaw arm.
Figure 20:
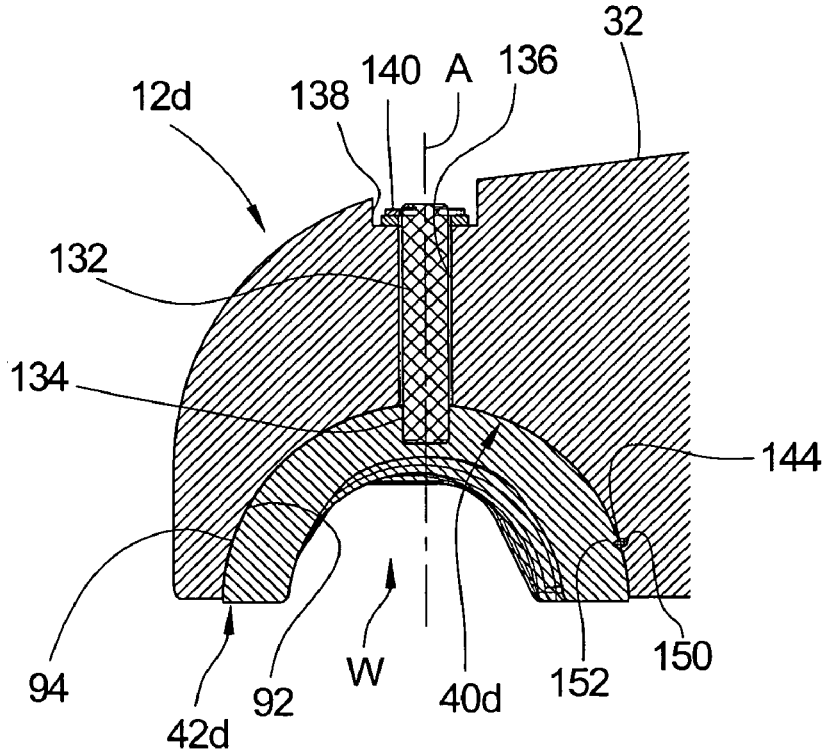
FIG. 20 is a cross-sectional view taken along line 20—20 in FIG. 19.

FIGS. 19 and 20 illustrate yet another arrangement for pivotally mounting an insert on a jaw arm and another arrangement for limiting pivotal displacement of the insert relative to the jaw arm. In this embodiment, the jaw arm designated 12D has a recess 40D, and the recess and insert which is designed 42D have spherical supporting surfaces 92 and 94, respectively, as in the embodiments of FIGS. 14–18. The insert is removably mounted in the jaw arm recess by a post or pin 132 mounted in a bore 134 in the insert, such as by an interference fit, and a bore 136 in the jaw arm which pivotally receives the post. Outer edge 32 of the jaw arm includes a recess 138, and post 132 extends through bore 136 into recess 138 and receives a split retaining ring 140 to removably secure the insert in place. Pivotal displacement of the insert in opposite directions about axis A is limited in this embodiment by a floating stop element 142 having an arcuate body portion 144 of a length greater than the width of the jaw arm and having T-shaped ends 146 and 148 extending forwardly and rearwardly of the body portion. The body portion is slidably received in opposed arcuate cavities 150 and 152, respectively extending into the jaw arm from surface 92 and into the insert from surface 94. As will be appreciated from FIG. 19, when the insert is pivoted counterclockwise about axis A T-shaped end 148 engages against side 20 of the jaw arm and T-shaped end 146 engages against the outer side 68 of the insert to limit the pivotal displacement. When the insert is pivoted in the opposite direction, T-shaped end 146 engages side 22 of the jaw arm and T-shaped end 148 is engaged by the outer side 66 of the insert to limit the displacement in the clockwise direction.

Figure 21:
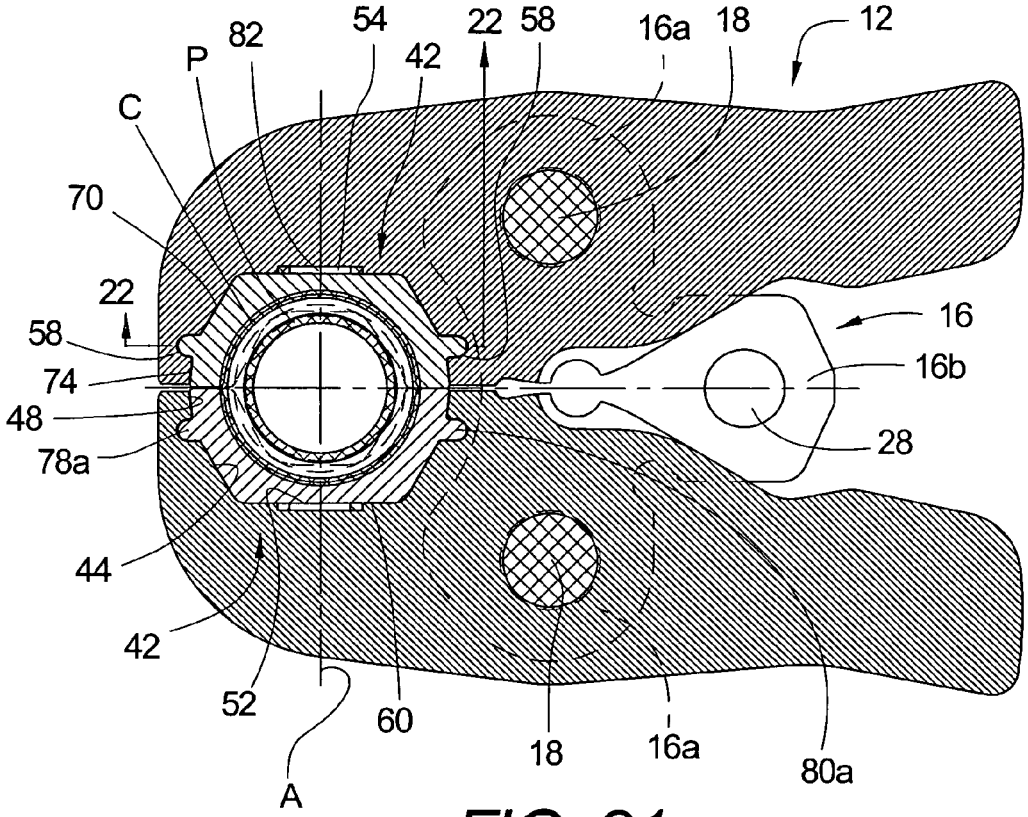
FIG. 21 is a plan view similar to FIG. 8 and showing a modification of the jaw inserts for limiting pivotal displacement thereof; and, FIG. 22 is a cross-sectional view taken along line 22—22 in FIG. 21.
Figure 22:
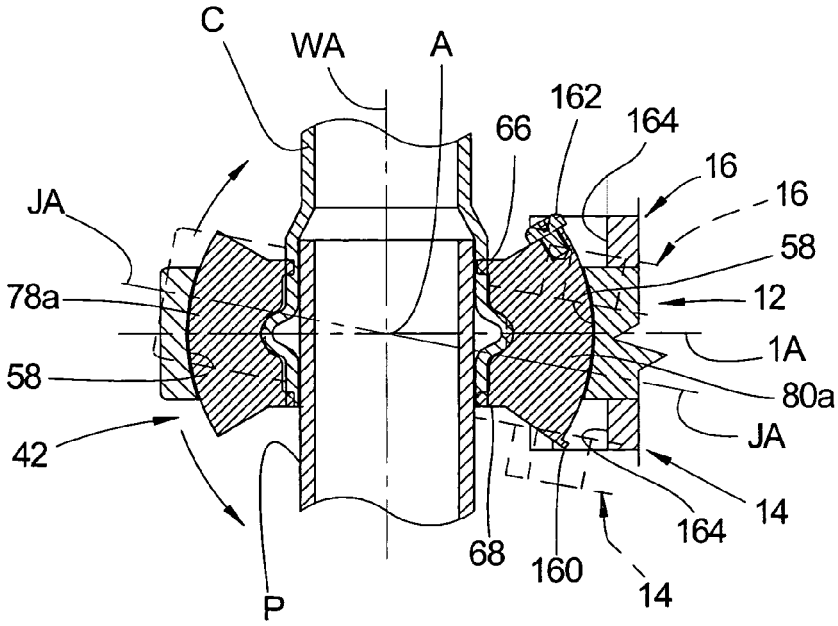

FIGS. 21 and 22 illustrate yet another arrangement for removably mounting an insert in a jaw arm and for limiting pivotal displacement of the insert relative to the jaw arms. The component parts in this embodiment are similar to those shown in FIGS. 8 and 9, whereby like numerals are used in FIGS. 21 and 22 to designate the same components. In this embodiment, the insert 42 is axially retained in the jaw arm recess by interengaging projections on the insert and slots in the jaw arm recess, and the projections which are designated 78*a* and 80*a* are extended laterally outwardly of the opposite sides 66 and 68 of the insert so as to provide for a greater angle of articulation between the insert and jaw arm than that provided by the arrangement in FIGS. 8 and 9 of the drawing. The laterally outer ends of projection 80*a* are provided with rearwardly extending stops which, for purposes of brevity, are shown one as a finger 160 integral with the insert and the other as a headed fastener 162 threadedly interenegaged with a threaded bore in the insert. Preferably, so as to optimize the angle of articulation, each of the side plates 14 and 16 is provided with a recess 164 which receives the corresponding one of the finger and fastener head and allows the latter to engage the corresponding side of the jaw arm to limit the pivotal displacement of the insert. While shown as a finger and a headed fastener, it will be appreciated that both stops can be provided by fingers or headed fasteners. As an alternative to the recess arrangement shown, it will be appreciated that the recesses do not have to extend all of the way through the side plates. As a further alternative, it will be appreciated that the stop fingers and/or fasteners could be provided on the laterally outer ends of projection 78*a* so as to engage the outer sides of the jaw arm at the corresponding end thereof.

While considerable emphasis has been placed herein on the structures of and the structural interrelationships between the component parts of preferred embodiments of the invention, it will be appreciated that other embodiments can be devised and that many changes can be made in the embodiments disclosed herein without departing from the principles of the present invention. In particular in this respect, jaw arms as used herein and in the appended claims are intended to include one of a pair of jaw arms in a jaw set of the character shown, for example, in the aforementioned patent to Amherd and one of a pair of jaw arms in a crimping ring of the character shown, for example, in the aforementioned patent to Viegener. Further, it will be appreciated that either of the arrangements disclosed for limiting pivotal displacement of an insert relative to a jaw arm can be used with any of the mounting arrangements illustrated and described, as well as other mounting arrangements which can be devised and, similarly, that the arrangements for providing a required torque for pivoting an insert relative to the corresponding jaw arm are interchangeable. These and other modifications of the disclosed embodiments as well as other embodiments of the invention will be obvious and suggested to those skilled in the art upon reading the foregoing disclosure. Accordingly, it is to be distinctly understood that the descriptive matter herein is to be interpreted merely as illustrative of the invention and not as a limitation and that it is intended to include other embodiments and all modifications of the preferred embodiments insofar as they come within the scope of the appended claims or the equivalents thereof.

Having thus described the invention, it is so claimed:

1. A jaw arm for use with a compression tool to compress an associated coupling, said jaw arm having a pivot axis, opposite ends spaced from said pivot axis and inner and outer edges between said opposite ends, a jaw recess opening outwardly from said inner edge toward said outer edge, and a jaw insert supported in said recess for pivotal displacement relative thereto about an insert axis transverse to said pivot axis, the jaw insert having an arcuate working surface disposed between said inner and outer edges and between said opposite ends and being adapted to engage the associated coupling.

2. A jaw arm according to claim 1, wherein said jaw recess and said jaw insert have slidably interengaging surfaces.

3. A jaw arm according to claim 2, wherein said interengaging surfaces are arcuate.

4. A jaw arm according to claim 3, wherein said jaw recess and said jaw insert are interengaged against pivotal displacement of said insert about an axis parallel to said pivot axis.

5. A jaw arm according to claim 1, wherein said jaw recess and said jaw insert are interengaged against pivotal displacement of said insert about an axis parallel to said pivot axis.

6. A jaw arm according to claim 1, and retaining means releasably interengaging said insert in said jaw recess.

7. A jaw arm according to claim 1, and a biasing spring between said jaw recess and said insert.

8. A jaw arm according to claim 7, wherein said spring biases said insert radially outwardly of said jaw recess.

9. A jaw arm according to claim 7, wherein said spring biases said insert radially inwardly of said recess.

10. A jaw arm according to claim 9, and means interengaging said jaw arm and insert to limit radial inward displacement of the insert by said spring.

11. A jaw arm for a compression tool, said jaw arm having a pivot axis; opposite ends spaced from said pivot axis and inner and outer edges between said opposite ends; a jaw recess opening outwardly from said inner edge toward said outer edge; a jaw insert supported in said recess for pivotal displacement relative thereto about an insert axis transverse to said pivot axis; and retaining means releasably interengaging said insert in said jaw recess, wherein said retaining means includes a slot in one of said recess and arm extending in the direction between said opposite ends and a projection on the other of said recess and arm slidably received in said slot.

12. A jaw arm according to claim 6, wherein said retaining means includes a post on said insert and means on said jaw arm releasably interengaging with said post.

13. A jaw arm according to claim 12, wherein said jaw arm includes a bore for said post extending from said recess toward said outer edge, and means interengaging with said post to releasably retain the post in the bore.

14. A jaw arm for a compression tool, said jaw arm having a pivot axis; opposite ends spaced from said pivot axis and inner and outer edges between said opposite ends; a jaw recess opening outwardly from said inner edge toward said outer edge; a jaw insert supported in said recess for pivotal displacement relative thereto about an insert axis transverse to said pivot axis; and retaining means releasably interengaging said insert in said jaw recess, wherein said retaining means includes a post on said insert and means on said jaw arm releasably interengaging with said post, and wherein said jaw arm includes a bore for said post extending from said recess toward said outer edge, and means interengaging with said post to releasably retain the post in the bore, wherein said means interengaging with said post includes a spring biased detent.

15. A jaw arm according to claim 14, wherein said detent laterally engages said post and the bias of the detent is adjustable.

16. A jaw arm for use with a compression tool to compress an associated workpiece, said jaw arm having a pivot axis; opposite ends spaced from said pivot axis and inner and outer edges between said opposite ends; a jaw recess opening outwardly from said inner edge toward said outer edge; a jaw insert supported in said recess for pivotal displacement relative thereto about an insert axis transverse to said pivot axis; and retaining means releasably interengaging said insert in said jaw recess, wherein said retaining means includes a post on said insert and means on said jaw arm releasably interengaging with said post, and wherein said jaw arm includes a bore for said post extending from said recess toward said outer edge, and means interengaging with said post to releasably retain the post in the bore, wherein said bore opens through said outer edge and said post has an outer end, and a retaining ring between said outer end and said outer edge.

17. A jaw arm according to claim 16, and a biasing spring interposed between said outer edge and said retaining ring.

18. A jaw arm according to claim 16, and a knob on said outer end of said post.

19. A jaw arm according to claim 18, and a biasing spring interposed between said outer edge and said retaining ring.

20. A jaw arm for use with a compression tool to compress an associated workpiece, said jaw arm having a pivot axis; opposite ends spaced from said pivot axis and inner and outer edges between said opposite ends; a jaw recess opening outwardly from said inner edge toward said outer edge; a jaw insert supported in said recess for pivotal displacement relative thereto about an insert axis transverse to said pivot axis; and retaining means releasably interengaging said insert in said jaw recess, wherein said retaining means includes an arcuate slot in said jaw arm radially outwardly of said jaw recess and opening through said inner edge of the jaw arm and a post on said insert slidably received in said slot.

21. A jaw arm according to claim 20, wherein said slot and post are T-shaped in cross-section.

22. A jaw arm according to claim 20, and a biasing spring between said post and said slot.

23. A jaw arm according to claim 22, wherein said slot and post are T-shaped in cross-section.

24. A jaw arm for a compression tool, said jaw arm having a pivot axis; opposite ends spaced from said pivot axis and inner and outer edges between said opposite ends; a jaw recess opening outwardly from said inner edge toward said outer edge; and a jaw insert supported in said recess for pivotal displacement relative thereto about an insert axis transverse to said pivot axis, wherein said jaw arm includes opposed slots in said recess and said insert includes projections slidably received in said slots.

25. A jaw arm for compression tools, said jaw arm having a pivot axis, opposite ends spaced from said pivot axis and inner and outer edges between said opposite ends, a jaw recess opening outwardly from said inner edge toward said outer edge, and a jaw insert supported in said recess for pivotal displacement relative thereof, said jaw arm having axially opposite sides with respect to said pivot axis, said opposite sides providing said recess with a width which is greater in the direction toward said one end of said jaw arm than in the direction toward the other of said opposite ends of said jaw arm.

26. A compression tool comprising, a pair of parallel spaced apart side plates having front ends, a pair of jaw arms between said plates, each said jaw arm being mounted between said plates for pivotal displacement about a corresponding pivot axis, each said jaw arm having inner and outer edges laterally spaced from and extending forwardly of the corresponding pivot axis, the inner edge of each jaw arm including a laterally inwardly open jaw recess forwardly of said front ends of said side plates, and a jaw insert supported in each of the jaw recesses and having a working surface between said inner and outer edges of each of the jaw arms for pivotal displacement relative thereto, the jaw arms during use of the compression tool being pivoted about the corresponding pivot axis to displace said jaw recesses laterally toward one another for the working surfaces of the inserts to compress an object therebetween, and said insert being pivotal about an insert axis transverse to the corresponding pivot axis.

27. A compression tool according to claim 26, and means for aligning said inserts relative to one another during lateral inward displacement of the recesses.

28. A compression tool according to claim 26, and means for limiting pivotal displacement of the jaw insert about said insert axis.

29. A compression tool according to claim 28, wherein said means for limiting pivotal displacement includes means on the insert engaging against one of the jaw arms and the side plates in response to pivotal movement of the insert.

30. A compression tool according to claim 26, and retaining means releasably interengaging each said insert in the corresponding jaw recess.

31. A compression tool according to claim 26, and stop means interengaging each insert and the corresponding jaw arm to limit pivotal displacement of the insert relative to the jaw arm.

32. A compression tool according to claim 26, wherein each jaw arm has axially opposite sides with respect to the corresponding pivot axis, and the corresponding recess has front and rear ends, said opposite sides providing for said front end of the recess to be wider than said rear end in the direction between said sides.

33. A compression tool according to claim 29, wherein said means on the insert is between the side plates.

34. A compression tool according to claim 29, wherein said insert has opposite sides and said means on the insert are laterally outwardly of the opposite sides thereof.

35. A compression tool comprising: a pair of parallel spaced apart side plates having front ends; a pair of jaw arms between said plates, each said jaw arm being mounted between said plates for pivotal displacement about a corresponding pivot axis, each said jaw arm having inner and outer edges laterally spaced from and extending forwardly of the corresponding pivot axis, the inner edge of each jaw arm including a laterally inwardly open jaw recess forwardly of said front ends of said side plates; a jaw insert supported in each of the jaw recesses for pivotal displacement relative thereto, the jaw arms during use of the compression tool being pivoted about the corresponding pivot axis to displace said jaw recesses laterally toward one another for the inserts to compress an object therebetween, and said insert being pivotal about an insert axis transverse to the corresponding pivot axis; and means for aligning said inserts relative to one another during lateral inward displacement of the recesses, wherein said inserts have laterally inwardly opposed faces, said means for aligning said inserts including interengaging means on said faces.

36. A compression tool according to claim 35, wherein said interengaging means includes a projection on one of said faces and a recess on the other of said faces.

37. A compression tool comprising: a pair of parallel spaced apart side plates having front ends; a pair of jaw arms between said plates, each said jaw arm being mounted between said plates for pivotal displacement about a corresponding pivot axis, each said jaw arm having inner and outer edges laterally spaced from and extending forwardly of the corresponding pivot axis, the inner edge of each jaw arm including a laterally inwardly open jaw recess forwardly of said front ends of said side plates; a jaw insert supported in each of the jaw recesses for pivotal displacement relative thereto, the jaw arms during use of the compression tool being pivoted about the corresponding pivot axis to displace said jaw recesses laterally toward one another for the inserts to compress an object therebetween, and said insert being pivotal about an insert axis transverse to the corresponding pivot axis; and retaining means releasably interengaging each said insert in the corresponding jaw recess, wherein said retaining means includes a slot in one of said recess and arm extending in the direction between said opposite ends and a projection on the other of said recess and arm slidably received in said slot.

38. A compression tool according to claim 37, and a compression spring interposed between each insert and the corresponding jaw recess.

39. A compression tool according to claim 37, wherein said projection is on said insert between said side plates and engages the side plates to limit pivotal displacement of the insert.

40. A compression tool according to claim 39, and a compression spring interposed between each insert and the corresponding jaw recess.

41. A compression tool according to claim 37, wherein said insert has opposite sides, and said projection is on said insert and includes opposite ends laterally outwardly of the opposite sides to engage one of the side plates and the opposite sides to limit pivotal displacement of the insert.

42. A compression tool comprising: a pair of parallel spaced apart side plates having front ends; a pair of jaw arms between said plates, each said jaw arm being mounted between said plates for pivotal displacement about a corresponding pivot axis, each said jaw arm having inner and outer edges laterally spaced from and extending forwardly of the corresponding pivot axis, the inner edge of each jaw arm including a laterally inwardly open jaw recess forwardly of said front ends of said side plates; a jaw insert supported in each of the jaw recesses for pivotal displacement relative thereto, the jaw arms during use of the compression tool being pivoted about the corresponding pivot axis to displace said jaw recesses laterally toward one another for the inserts to compress an object therebetween, and said insert being pivotal about an insert axis transverse to the corresponding pivot axis; and retaining means releasably interengaging each said insert in the corresponding jaw recess, wherein said retaining means includes a pair of opposed slots in each arm recess and a pair of opposed projections on each insert slidably received in the slots in the corresponding recess.

43. A compression tool according to claim 42, and a compression spring interposed between each insert and the corresponding jaw recess.

44. A compression tool according to claim 42, wherein one of the projections on each insert is between said side plates and engages the side plates to limit pivotal displacement of the insert.

45. A compression tool according to claim 44, and a compression spring interposed between each insert and the corresponding jaw recess.

46. A compression tool according to claim 42, and means for aligning said inserts relative to one another during lateral inward displacement of the recesses.

47. A compression tool according to claim 46, wherein said inserts have laterally inwardly opposed faces, said means for aligning said inserts including interengaging means on said faces.

48. A compression tool according to claim 47, wherein one of the projections on each insert is between said side plates and engages the side plates to limit pivotal displacement of the insert about the insert axis.

49. A compression tool according to claim 48, and a compression spring interposed between each insert and the corresponding jaw recess.

50. A compression tool according to claim 42, wherein each said insert has opposite sides and at least one of the projections on each insert has opposite ends laterally outwardly of the opposite sides for engaging one of the side plates and the opposite sides to limit pivotal displacement of the insert.

51. A compression tool comprising: a pair of parallel spaced apart side plates having front ends; a pair of jaw arms between said plates, each said jaw arm being mounted between said plates for pivotal displacement about a corresponding pivot axis, each said jaw arm having inner and outer edges laterally spaced from and extending forwardly of the corresponding pivot axis, the inner edge of each jaw arm including a laterally inwardly open jaw recess forwardly of said front ends of said side plates; a jaw insert supported in each of the jaw recesses for pivotal displacement relative thereto, the jaw arms during use of the compression tool being pivoted about the corresponding pivot axis to displace said jaw recesses laterally toward one another for the inserts to compress an object therebetween, and said insert being pivotal about an insert axis transverse to the corresponding pivot axis; and retaining means releasably interengaging each said insert in the corresponding jaw recess, wherein said retaining means includes a post on said insert and means on said jaw arm releasably interengaging with said post.

52. A compression tool according to claim 51, wherein said jaw arm includes a bore for said post extending from said recess toward said outer edge, and means interengaging with said post to releasably retain the post in the bore.

53. A compression tool according to claim 52, wherein said means interengaging with said post includes a spring biased detent.

54. A compression tool according to claim 53, wherein said detent laterally engages said post and the bias of the detent is adjustable.

55. A compression tool according to claim 52, wherein said bore opens through said outer edge and said post has an outer end, and a retaining ring between said outer end and said outer edge.

56. A compression tool according to claim 55, and a biasing spring interposed between said outer edge and said retaining ring.

57. A compression tool according to claim 55, and a knob on said outer end of said post.

58. A compression tool according to claim 57, and a biasing spring interposed between said outer edge and said retaining ring.

59. A compression tool comprising: a pair of parallel spaced apart side plates having front ends; a pair of jaw arms between said plates, each said jaw arm being mounted between said plates for pivotal displacement about a corresponding pivot axis, each said jaw arm having inner and outer edges laterally spaced from and extending forwardly of the corresponding pivot axis, the inner edge of each jaw arm including a laterally inwardly open jaw recess forwardly of said front ends of said side plates; a jaw insert supported in each of the jaw recesses for pivotal displacement relative thereto, the jaw arms during use of the compression tool being pivoted about the corresponding pivot axis to displace said jaw recesses laterally toward one another for the inserts to compress an object therebetween, and said insert being pivotal about an insert axis transverse to the corresponding pivot axis; and stop means interengaging each insert and the corresponding jaw arm to limit pivotal displacement of the insert relative to the jaw arm, wherein each jaw arm has axially opposite sides with respect to the corresponding pivot axis, and said stop means includes a stop member between the insert and jaw arm having opposite ends spaced apart a distance greater than that between said opposite sides.

60. A compression tool comprising: a pair of parallel spaced apart side plates having front ends; a pair of jaw arms between said plates, each said jaw arm being mounted between said plates for pivotal displacement about a corresponding pivot axis, each said jaw arm having inner and outer edges laterally spaced from and extending forwardly of the corresponding pivot axis, the inner edge of each jaw arm including a laterally inwardly open jaw recess forwardly of said front ends of said side plates; a jaw insert supported in each of the jaw recesses for pivotal displacement relative thereto, the jaw arms during use of the compression tool being pivoted about the corresponding pivot axis to displace said jaw recesses laterally toward one another for the inserts to compress an object therebetween, and said insert being pivotal about an insert axis transverse to the corresponding pivot axis; and stop means interengaging each insert and the corresponding jaw arm to limit pivotal displacement of the insert relative to the jaw arm, wherein each jaw arm has axially opposite sides with respect to the corresponding pivot axis, and said stop means includes a stop member on the insert having opposite ends spaced apart a distance greater than that between said opposite sides.

* * * * *